US008678196B2

(12) United States Patent
Kaiser et al.

(10) Patent No.: US 8,678,196 B2
(45) Date of Patent: Mar. 25, 2014

(54) AIR JET SIEVE DEVICE

(75) Inventors: Hans Kaiser, Neusäß (DE); Georg Konetzka, Augsburg (DE); Markus Schönwetter, Königsbrunn (DE)

(73) Assignee: Hosokawa Alpine Aktiengesellschaft, Augsburg (DE)

( * ) Notice: Subject to any disclaimer, the term of this patent is extended or adjusted under 35 U.S.C. 154(b) by 482 days.

(21) Appl. No.: 13/088,039

(22) Filed: Apr. 15, 2011

(65) Prior Publication Data

US 2011/0253601 A1 Oct. 20, 2011

(30) Foreign Application Priority Data

Apr. 17, 2010 (DE) ..... 10 2010 015 364

(51) Int. Cl.
*B07B 13/16* (2006.01)
*B07B 1/04* (2006.01)
*B07B 1/50* (2006.01)

(52) U.S. Cl.
USPC ..... 209/250; 209/352; 209/380

(58) Field of Classification Search
USPC ..... 209/250, 352, 380
See application file for complete search history.

(56) References Cited

U.S. PATENT DOCUMENTS 4,261,817 A * 4/1981 Edwards et al. ..... 209/321
4,970,004 A * 11/1990 Rosaen ..... 210/741
5,570,789 A * 11/1996 Dunn ..... 209/12.2
7,896,163 B2 * 3/2011 Kato ..... 209/284
8,240,481 B2 * 8/2012 Kato ..... 209/284
2004/0174171 A1 9/2004 Desie et al. ..... 324/452

FOREIGN PATENT DOCUMENTS

DE 198 30 050 A1 1/2000
DE 100 22 391 A1 11/2001
EP 0 654 308 B1 5/1995

OTHER PUBLICATIONS

European Search Report, application No. EP 11002770 dated Sep. 27, 2011.

* cited by examiner

*Primary Examiner* — David H Bollinger
(74) *Attorney, Agent, or Firm* — Winston & Strawn LLP

(57) ABSTRACT

The invention relates to an air jet sieve device having a housing, at least one sieve for insertion in the housing, a sieve deck and chamber located below the sieve, a slotted nozzle beneath the sieve deck, a drive for the slotted nozzle, an air inlet to the slotted nozzle, an air outlet through the housing and out of the chamber located beneath the sieve deck, and a control unit to control operation of the device. The invention also relates to a method that permits not only detection of the sieving progress during a sieving process but also provides a criterion to permit establishing the sieving time. This is achieved by equipping the sieving machine with a measuring sensor through which the particles in the air outlet flow are detected triboelectrically and which are correlated with the sieving progress to permit establishing the sieving time.

18 Claims, 7 Drawing Sheets

AIR JET SIEVE DEVICE

BACKGROUND

The invention relates to an air jet sieve device having a housing, at least one sieve for insertion in the housing, a sieve deck, a slotted nozzle beneath the sieve deck, a drive for the slotted nozzle, an air inlet to the slotted nozzle, an air outlet through the housing and out of the chamber located beneath the sieve deck and a control unit for operation of the device. The invention also relates to a method of operating the air jet sieve device.

Air jet sieve devices of this type are used for analysis sieving to determine fineness values and particle size distributions of dry materials in powder form. Analysis sieving processes are becoming increasingly automated in an effort to rule out operating errors and to achieve a high degree of measuring accuracy and reproducibility.

An air jet sieve device of this type comprises a housing upon which a sieve with flat sieve deck is placed. The sieving chamber above the sieve deck is sealed off during sieving with a cover. Underneath the sieve deck is a chamber in which a rotating slotted nozzle is located that rotates around the vertical central axis of the sieve. During a sieving process, air is blown from below through the uniformly rotating slotted nozzle against the sieve deck. The air jet purges the apertures of the sieve gauze, thus agitating the feed material lying on the sieve. The fines portion of the feed material becomes entrained in the air jet and is transported through the sieve gauze from top to bottom into the chamber underneath the sieve and from there is discharged out of the sieving machine. The coarse particles that are larger than the mesh width of the respective sieve cannot pass through the sieve and remain on the sieve gauze after sieving.

In order to determine particle size distribution, several sieving processes must be carried out with sieves of different mesh width. To this end, the sieve residue remaining on the sieve after every sieving process is subjected to further sieving processes. The sieve residue must be weighed after every sieving process to permit determination of the particle size distribution curve. As an alternative, fresh material can be weighed in for every different sieve.

In the past, air jet sieve devices were operated manually but in the last years, there has been an effort to automate analysis sieving processes in that essential process parameters such as batch weight, sieving time, air flow rate and underpressure are automatically detected and adjusted. From the prior art, the integration of load cells into the air jet sieve device to permit automatic measurement of the batch weight is generally known. A control unit for air jet sieve devices is also known where as input variables, the mesh width of the sieve, material properties of the sample and/or application area of the material can be entered which based on previously defined sieving parameters such as underpressure can be recorded and controlled and where the sieving time is preset. It is possible in this way to carry out sieving processes in accordance with internal testing specifications and to realize exactly reproducible, automated analyses. Over and above this, sieving machines can be equipped with sensors which automatically identify the mesh width of the inserted sieve and possibly also store additional information in the sieving machine or even direct in the sieve in order to increase the analysis reliability of analysis sieving machines in general against operating errors.

The measurement and regulation of the air flow rate of air jet sieve devices is known from European patent EP 0 654 308 B1. This makes it possible to keep the gas flow constant throughout the duration of the sieving process. In addition, detection of the amount of particles in the outlet gas flow and an associated analysis abort criterion derived from this is also known from this patent. Optical detection of the particle flow is proposed.

From German patent application DE 100 22 391 A1, the measurement of dust in flowing gases under the application of the triboelectrical effect is known. This is a qualitative dust measurement. The principle bases on the transfer of charges when two substances are brought together through either contact or surface friction. The difference in charge forms the basis for the triboelectric measurement. This makes it possible to carry out a qualitative monitoring of the dust concentration and a relative allocation of the particle concentration. An exact allocation of the measuring signal to the dust concentration is only possible in cases where the speed of the air flow is constant.

The optical methods already known are disadvantageous in that they require sensitive and cost-intensive measuring technology for detecting the particles in the gas flow optically, especially in the case of abrasive products. Two components are necessary for this optical method, namely a transmitter and a receiver. These are separated from the particle flow by panes of glass and the glass must be kept free from dust, which is extremely laborious. These measures call for a large overall size of the equipment. The preset of constant sieving times—even if they do differ for sieves with different mesh widths and different materials—leads to a varying degree of stress on the material, specially in the case of materials that are not wear-resistant because of different sieving periods depending on the sieve mesh width and thus to an falsification of the measuring result.

Accordingly the prior devices and methods are not desirable and improvements in these technologies are desired. Certain improvements are now provided by the present invention.

SUMMARY OF THE INVENTION

The invention now provides a solution which permits detection of the sieving progress during a sieving process with an air jet sieve device in order to be able to ascertain the sieving time. In the case of an air jet sieve device of the type described herein, this is achieved by equipping the device with a measuring sensor which allows the particles in flow direction downstream of the sieve deck to be detected triboelectrically.

In particular, the invention provides an air jet sieve device having a housing, at least one sieve for insertion in the housing, a chamber beneath the sieve, a slotted nozzle beneath the sieve, a drive for the slotted nozzle, an air inlet to the slotted nozzle and an air outlet through the housing and out of the chamber wherein an air flow is established between the air inlet and air outlet, a control unit for operation of the air jet sieve, and a measuring sensor for triboelectrically detecting particles in the air flow. The air jet sieve device may also include a sieve that includes a sieve deck and an annular supporting structure in which the sieve deck is tensioned and a filter downstream of the sieve, wherein the measuring sensor is advantageously positioned to detect particles in the air flow downstream of the sieve deck and upstream of the filter.

The air outlet of the air jet sieve device may include an air outlet channel such that the measuring sensor may be located in the air outlet channel. The air jet sieve device may also include a pressure sensor such that the measuring sensor can be connected to the pressure sensor for measuring underpressure in the air jet sieve device.

The measuring sensor may also be located on a wall or floor of the chamber beneath the sieve. Alternatively, the measuring sensor may be located in the slotted nozzle. Preferably, the measuring sensor is configured to wirelessly transmit measuring signals.

The invention also relates to a method of operating an air jet sieve device as disclosed herein by measurement of particle size of a material sample. This method comprises detecting particles in the air flow downstream of the sieve, correlating the detected particles with the sieving progress and establishing a sieving time for the operation of the device. The particles may be detected in an outlet air flow by the measuring sensor in accordance with triboelectrical measurement principles with the sensor providing a measuring signal that is plotted over time to determine a signal gradient that can be used as a basis for establishing the sieving time. This method can be used for establishing a sieving time for operation of other air jet sieve devices by detecting particles in an air flow of the device, and correlating the detected particles with sieving progress.

BRIEF DESCRIPTION OF THE DRAWING FIGURES

Additional features of the invention will become apparent upon a review of the drawing figure and detail description that follows, wherein.

DETAILED DESCRIPTION OF THE PREFERRED EMBODIMENTS

Figure 1:
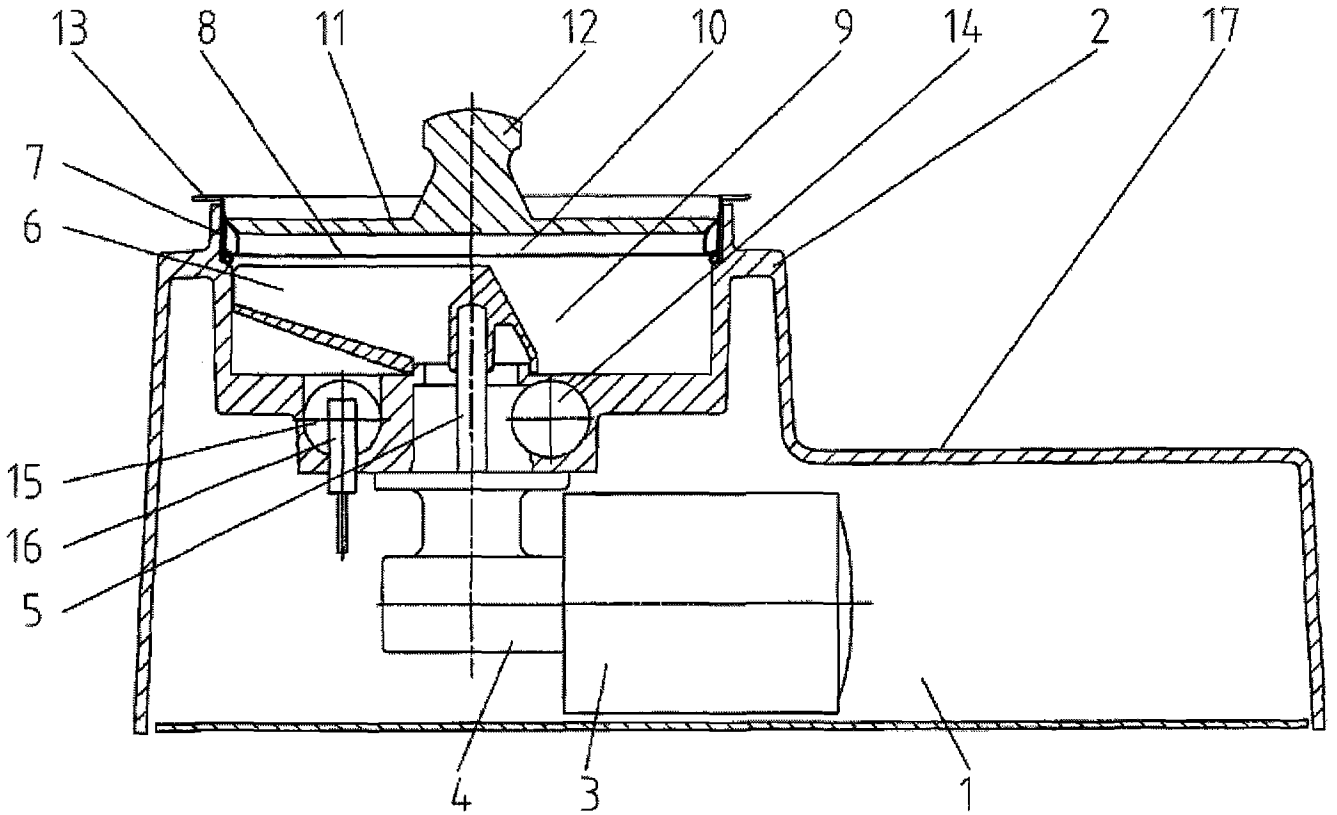
FIG. 1 shows a sectional view of the air jet sieve device with a measuring sensor in accordance with the invention.

A crucial process parameter for every sieving process is the sieving time. The sieving time of a sieving process influences the cut point and precision of cut. Ideally, the sieving time is selected such that only material which is larger than the mesh width of the sieve is present on the sieve, meaning that there is no more material present in the air flow extracted by suction. However, because the material being sieved does not behave in an ideal way—e.g., the batch weights processed are not constant, the material is not abrasion-resistant, is sticky, becomes electrostatically charged, the particle shape is not spherical—the duration of a sieving process can be immeasurably long. The sieving time is also dependent on the mesh width of the selected sieve. The sieving time of sieving processes with sieves that have a large mesh width is lower than that for sieves with a narrow mesh width. The sieving time must not be chosen too long because sensitive products would otherwise be stressed too highly with the result that comminution or frictional processes occur during the sieving process. Seen from the point of view of economic efficiency, the sieving time should be as short as possible but the sieving processes should simultaneously be representative and reproducible.

In accordance with the invention, an air jet sieve device is equipped with the kind of measuring technology which permits determination of the sieving progress and also to specify the sieving time of an analysis as a function of the material and sieve mesh width in a reproducible manner.

Dust measurement in accordance with the triboelectrical principle is advantageous for this purpose. The measuring sensor is installed in flow direction downstream of the sieve deck in the air jet sieve device, for example, in the air outlet channel. The air that exits the slotted nozzle and passes through the sieve deck from bottom to top and which entrains material that is smaller than the mesh width of the sieve on its return journey from top to bottom through the sieve deck flows through this air outlet channel. Upon contact with the measuring sensor, the particles in the air flow generate a signal caused by friction.

The raw signals picked up by a triboelectric sensor are extremely small because only a very few charges are passed on and transmitted. Because of this, a charge amplifier must be connected such that it is particularly high in resistivity and must also display a high amplification factor. Such systems are susceptible to interference caused by spurious signals. As a result, the sensor and the amplifier must be linked by cables that are as short and interference-free as possible. The ideal case would be to forego the cables used to transport the triboelectrically generated charges completely and to link the sensor and the amplifier directly with one another. As an exemplary design, the printed circuit board of the amplifier—which is located completely or partially in a screened housing—is screwed directly to the sensor.

Furthermore, the installation of components such as measuring sensors in a ducting through which a gas-particle mixture flows is always associated with disadvantages such as contamination, wear and interference to the flow behavior. To minimize these disadvantages, the sensor rod that is anyway necessary to measure the pressure is mounted to be insulated and is thus combined with the triboelectric sensor.

The triboelectric sensor can be integrated at any point in the air jet sieve device in flow direction downstream of the sieve deck, namely wherever the particle-air flow flows along a surface subsequent to the sieving process. The sensor can also be designed as a flat element on the floor or wall of the chamber underneath the sieve deck.

In another design, the triboelectric sensor can be integrated into the slotted nozzle. This qualitative signal from the triboelectric sensor is detected as a function of time and can be correlated with the sieving progress. The signal profile is used to establish the sieving time.

Sieving processes can only be performed in such a cost-effective manner because the sieving time of every sieving process is adjusted to suit the feed material and sieving conditions. Application of the triboelectrical measuring principle to detect the particles in the outlet air flow represents a rational measuring method. The measuring sensor is simple in design, small in size and is insensitive to contamination and wear.

And finally, the invention is also characterized by a method of operating the air jet sieve device where the particles in the outlet air flow are detected and correlated with the sieving progress.

Detection of the particles in the outlet air flow is carried out according to the triboelectrical principle. To this end, the qualitative measuring signal of the triboelectric sensor is plotted over time and the gradient of the signal is used to establish the sieving time.

A sectional view of the air jet sieve device 1 is shown in FIG. 1. The housing 2 houses the drive motor 3 and the gear unit 4 with drive shaft 5 for the slotted nozzle 6. Together with the sieve deck 8, the housing 2 forms the chamber 9 underneath the sieve deck 8 in which the slotted nozzle 6 is located. The sieving chamber 10 is delimited by the sieve deck 8 and the cover 11. The cover 11 has a handle to permit manual opening and closing of the sieving chamber 10. The sieve 7 consists of an annular supporting structure 13 in which the sieve deck is tensioned. The supporting structure 13 of the sieve is placed loosely in the housing 2 and is centered by means of a conical ledge inside the housing 2. Air is supplied to the slotted nozzle 6 via the air inlet channel 14 and is blown against the sieve deck 8 from below. The air that enters the chamber 9 together with the fine particles is sucked out of the housing 2 via the air outlet channel 15.

Figure 2:
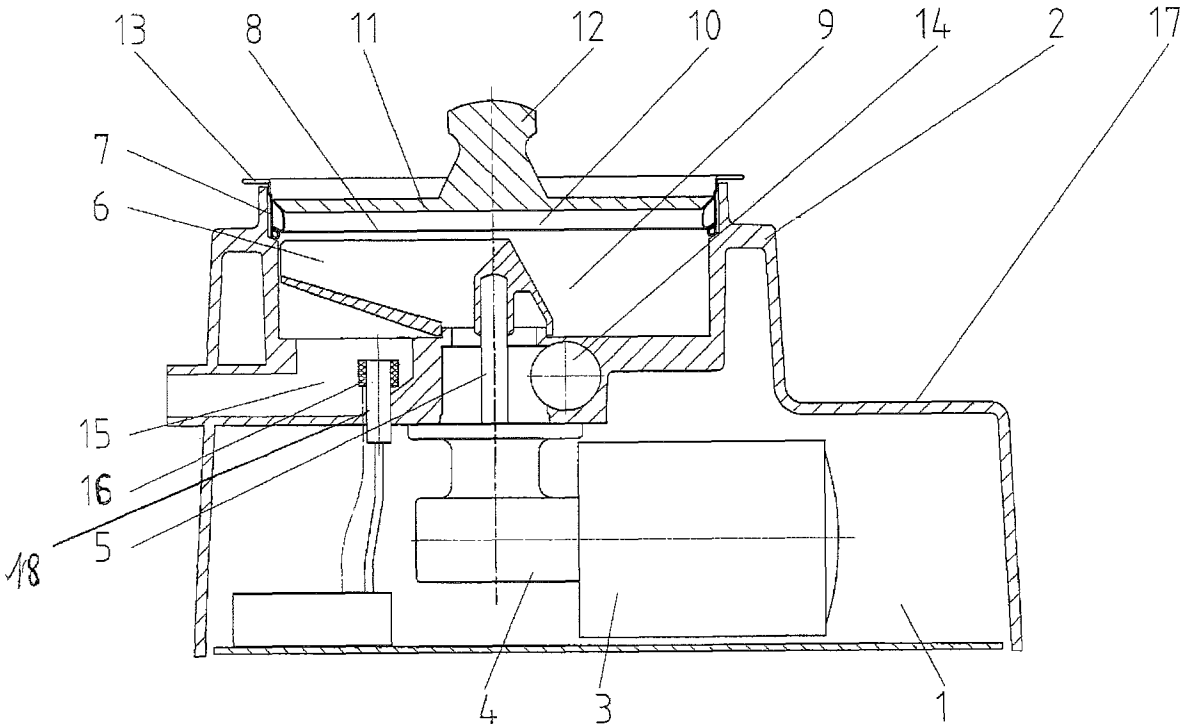
FIG. 2 shows a sectional view of the air jet sieve device to illustrate the measuring and pressure sensors.
Figure 3:
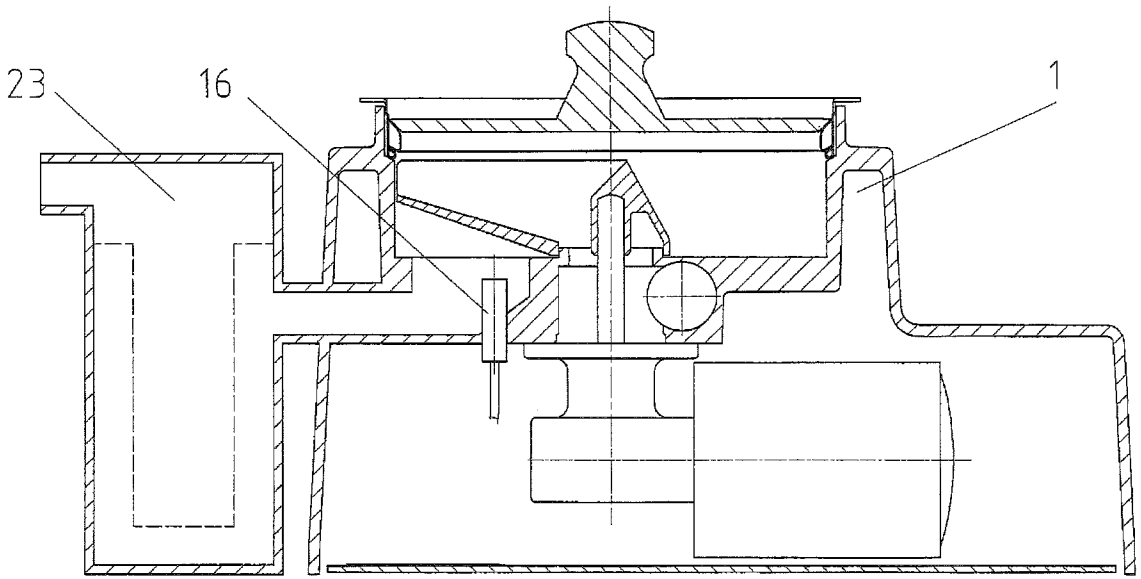
FIG. 3 shows a sectional view of the air jet sieve device to illustrate the inclusion of a filter.

In the air outlet channel 15 are located the measuring sensor 16 for the triboelectric dust measurement and part of the equipment to measure the differential pressure between the air inlet and the air outlet. FIG. 2 is a sectional view of the air jet sieve device showing the location of the measuring sensor 16 that is connected to pressure sensor 18. FIG. 3 is a sectional view of the air jet sieve device with a filter 23 located downstream of the sieve, wherein the measuring sensor is advantageously positioned to detect particles in the air flow downstream of the sieve deck and upstream of the filter.

Also integrated into the housing is the control panel 17. It has a keyboard to permit entry of all the requisite values. Instead of the keyboard, a touch panel or a rotary-type pushbutton can also be used. A data interface to a computer can also be provided.

The electronic evaluation unit for the dust measurement and to determine the sieving progress as well as to establish the sieving time is integrated into the housing 2.

The triboelectric sensor 16 installed in the air outlet channel 15 is connected to the amplifier with cables that are as short and interference-free as possible. In another invention design, there are absolutely no cables to transport the triboelectrically generated charges, and the sensor and amplifier are connected direct to one another. In an exemplary design, the printed circuit board of the amplifier which is located totally or partly in a screened housing is screwed direct to the sensor.

Figure 4:
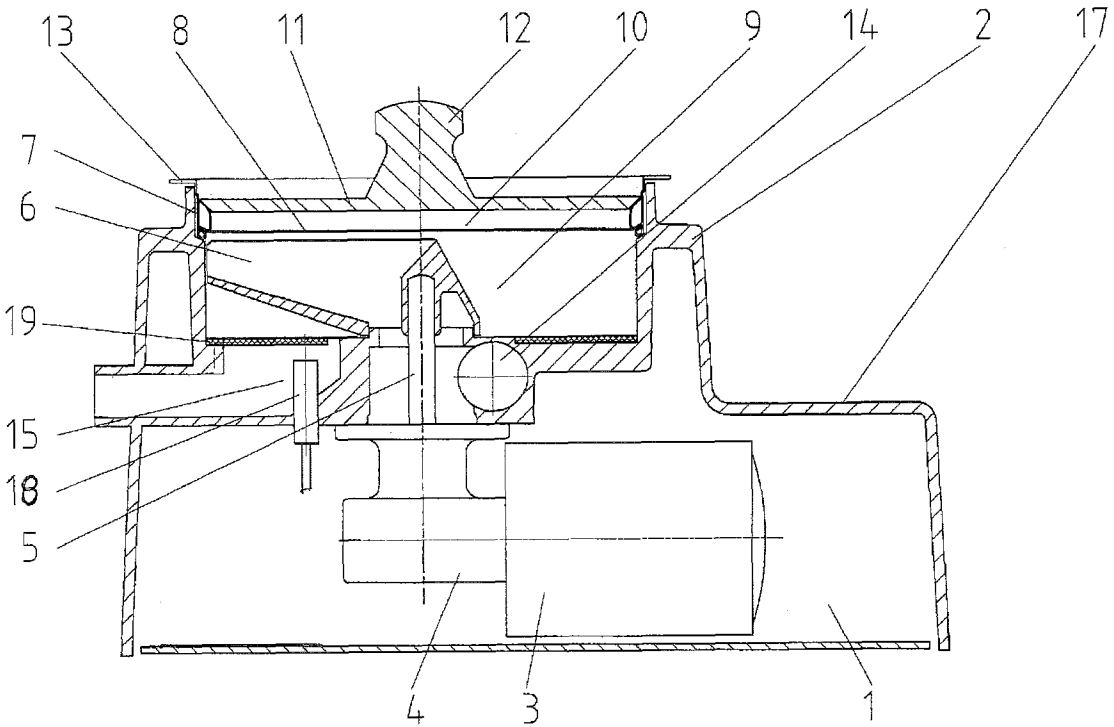
FIG. 4 shows a sectional view of the air jet sieve device with the measuring sensor integrated in the floor of the chamber.
Figure 5:
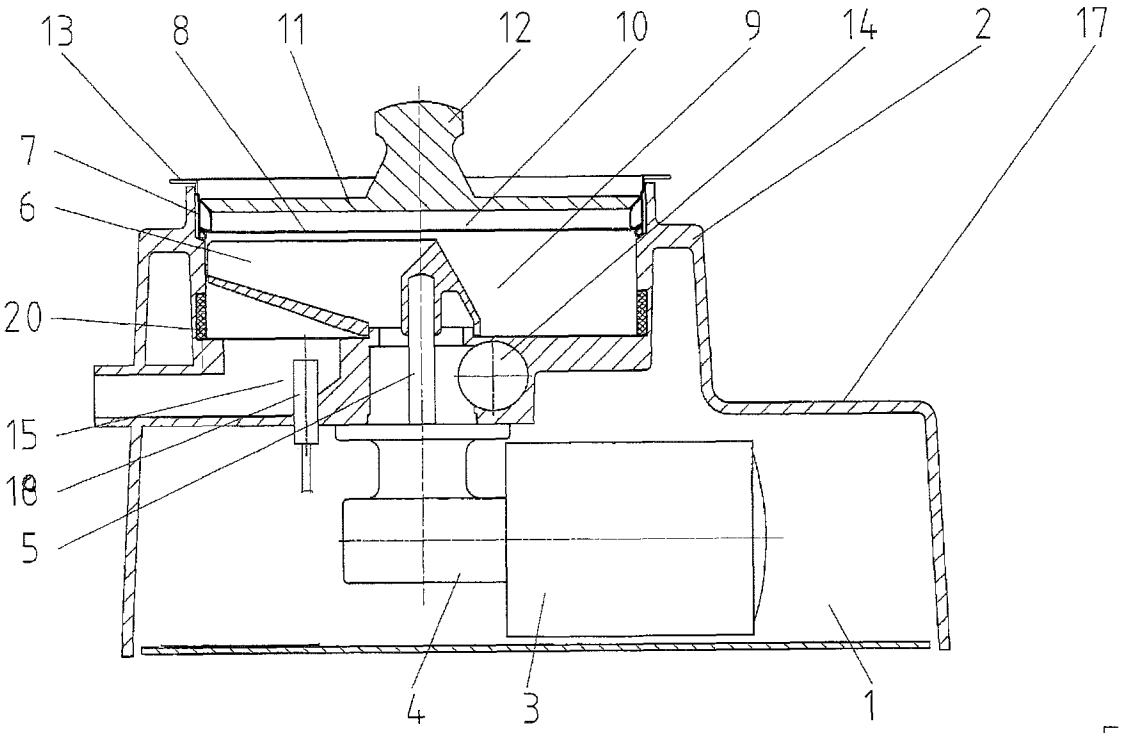
FIG. 5 shows a sectional view of the air jet sieve device with the measuring sensor integrated in the wall of the chamber.

The triboelectric sensor 16 can be integrated into the air jet sieve device at any point in flow direction downstream of the sieve deck 8, e.g., in the air outlet channel 15 or in a connecting line to the downstream filter, namely wherever the particle-air flow flows along a surface subsequent to the sieving process. The sensor can also be designed as a flat element on the floor and/or wall of the chamber underneath the sieve deck 8. FIG. 4 shows the measuring sensor 19 as a flat element integrated in the floor of the chamber near pressure sensor 18, while FIG. 5 shows the measuring sensor 20 as a flat element integrated in the wall of the chamber near pressure sensor 18.

Figure 6:
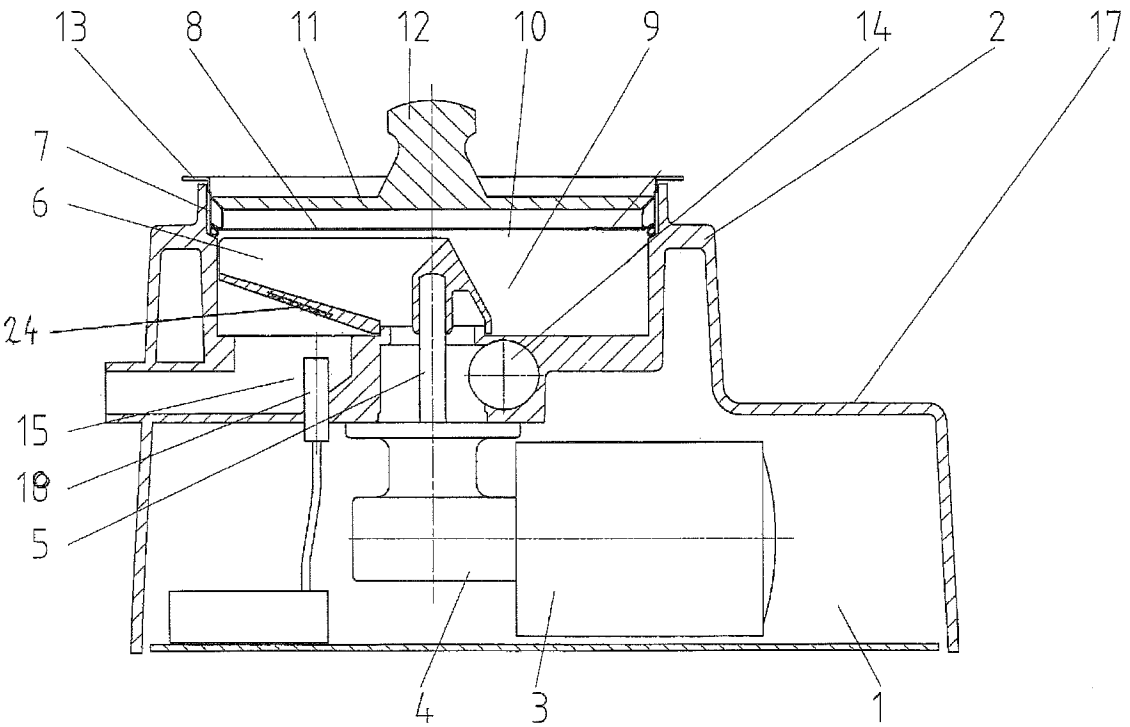
FIG. 6 shows a sectional view of the air jet sieve device with the measuring sensor integrated in the slotted nozzle.

In another design, the triboelectric sensor can be integrated into the slotted nozzle 6. In a preferred invention design, the sensor required to measure the pressure is fixed to be insulated in the air outlet channel 15 and is also used as a triboelectric sensor. FIG. 6 shows the measuring sensor 24 integrated in the slotted nozzle 6 near pressure sensor 18.

Figure 7:
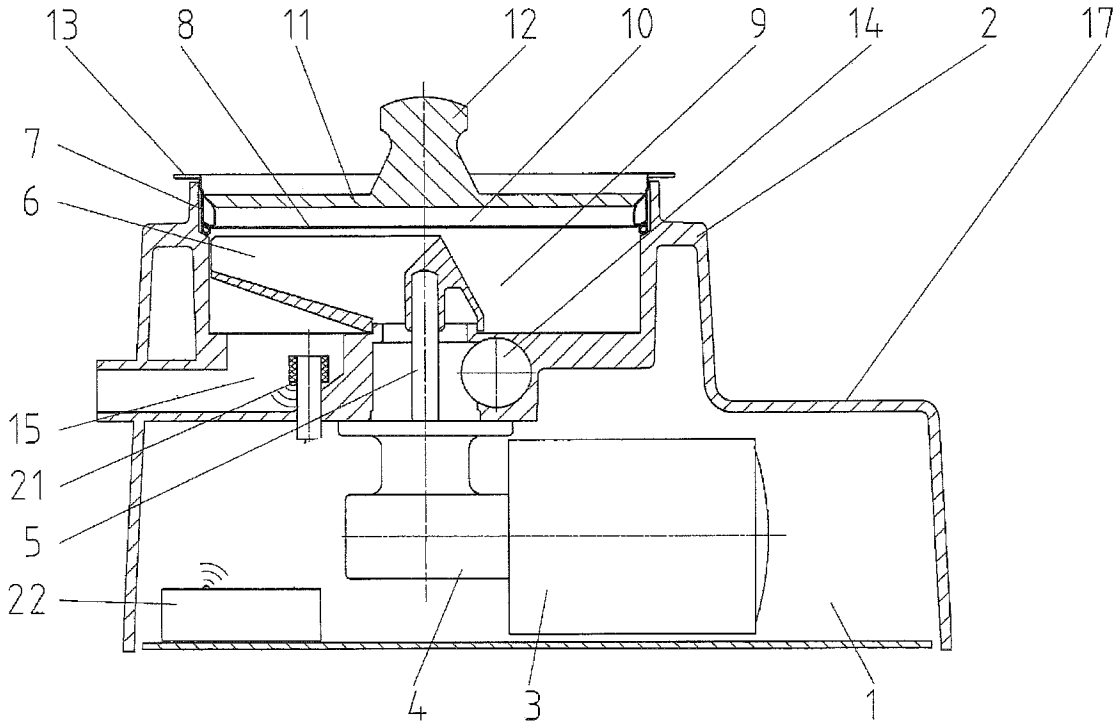
FIG. 7 shows a sectional view of the air jet sieve with the measuring sensor wireles sly transmitting the signals.

FIG. 7 shows a sectional view of the air jet sieve with the measuring sensor 21 wirelessly transmitting the measuring signals via amplifier 22. The triboelectric measuring signal is plotted over time, the sieving progress can be read off the resultant curve and the sieving time established accordingly.

What is claimed is:

1. An air jet sieve device having a housing, at least one sieve for insertion in the housing, a chamber beneath the sieve, a slotted nozzle beneath the sieve, a drive for the slotted nozzle, an air inlet to the slotted nozzle and an air outlet through the housing and out of the chamber wherein an air flow is established between the air inlet and air outlet, a control unit for operation of the air jet sieve, and a measuring sensor for triboelectrically detecting particles in the air flow, wherein the measuring sensor is configured and positioned to be contacted by particles in the air flow to generate a signal caused by friction.

2. The air jet sieve device of claim 1, wherein the sieve includes a sieve deck and an annular supporting structure in which the sieve deck is tensioned, wherein the measuring sensor is positioned to detect particles in the air flow downstream of the sieve deck.

3. The air jet sieve device of claim 1, wherein the air outlet comprises an air outlet channel and the measuring sensor is located in the air outlet channel.

4. The air jet sieve device of claim 1, wherein the measuring sensor is located in the slotted nozzle.

5. The air jet sieve device of claim 1, wherein the measuring sensor is configured to wirelessly transmit measuring signals.

6. A method of operating the air jet sieve device of claim 1 by measurement of particle size of a material sample, which method comprises detecting particles in the air flow downstream of the sieve by contact of the particles with the measuring sensor, correlating the detected particles with the sieving progress and establishing a sieving time for the operation of the device.

7. The method of claim 6, wherein the particles are detected in an air outlet flow by the measuring sensor in accordance with triboelectrical measurement principles and the sensor provides a measuring signal.

8. A method of operating the air jet sieve device of claim 1 by measurement of particle size of a material sample, which method comprises detecting particles in the air flow downstream of the sieve, correlating the detected particles with the sieving progress and establishing a sieving time for the operation of the device, wherein the particles are detected in an air outlet flow by the measuring sensor in accordance with triboelectrical measurement principles and the sensor provides a measuring signal, and further wherein the measuring signal of the measuring sensor is plotted over time to determine a signal gradient that is used as a basis for establishing the sieving time.

9. In a method for operating an air jet sieve device of claim 1, the improvement which comprises establishing a sieving time for operation of the device by detecting particles in an air flow of the device, and correlating the detected particles with sieving progress.

10. The method of claim 9, wherein the particles are detected in an air flow by a measuring sensor that utilizes triboelectrical measurement principles and the sensor provides a measuring signal that is plotted over time to determine a signal gradient that is used as a basis for establishing the sieving time.

11. The method of claim 10, wherein the measuring signals are wirelessly transmitted by the measuring sensor to a computer in order to establish a sieving time.

12. The method of claim 10, which comprises locating the measuring sensor on a wall and/or floor of the chamber beneath the sieve, or in the slotted nozzle.

13. The air jet sieve device of claim 1, wherein the measuring sensor provides a measuring signal that is transmitted and plotted over time to determine a signal gradient that is used as a basis for establishing the sieving time.

14. An air jet sieve device comprising a housing, at least one sieve for insertion in the housing, a chamber beneath the sieve, a slotted nozzle beneath the sieve, a drive for the slotted nozzle, an air inlet to the slotted nozzle and an air outlet through the housing and out of the chamber wherein an air flow is established between the air inlet and air outlet, a control unit for operation of the air jet sieve, a measuring sensor for triboelectrically detecting particles in the air flow, a sieve deck and a filter downstream of the sieve deck, wherein the measuring sensor is positioned to detect particles in the air flow downstream of the sieve deck and upstream of the filter.

15. An air jet sieve device comprising a housing, at least one sieve for insertion in the housing, a chamber beneath the sieve, a slotted nozzle beneath the sieve, a drive for the slotted nozzle, an air inlet to the slotted nozzle and an air outlet through the housing and out of the chamber wherein an air flow is established between the air inlet and air outlet, a control unit for operation of the air jet sieve, a measuring sensor for triboelectrically detecting particles in the air flow, and a pressure sensor wherein the measuring sensor is connected to the pressure sensor for measuring underpressure in the device.

16. An air jet sieve device comprising a housing, at least one sieve for insertion in the housing, a chamber beneath the sieve, a slotted nozzle beneath the sieve, a drive for the slotted nozzle, an air inlet to the slotted nozzle and an air outlet through the housing and out of the chamber wherein an air flow is established between the air inlet and air outlet, a control unit for operation of the air jet sieve, and a measuring sensor for triboelectrically detecting particles in the air flow, wherein the measuring sensor is located on a wall and/or floor of the chamber beneath the sieve, or in the slotted nozzle.

17. The air jet sieve device of claim 16, wherein the measuring sensor is a flat element located on a wall of the chamber beneath the sieve.

18. The air jet sieve device of claim 16, wherein the measuring sensor is a flat element located on a floor of the chamber beneath the sieve.

* * * * *